US010604339B2

(12) United States Patent
McKay et al.

(10) Patent No.: US 10,604,339 B2
(45) Date of Patent: Mar. 31, 2020

(54) EQUIPMENT SHIPPING, STORAGE, AND MAINTENANCE SUPPORT SYSTEM

(71) Applicant: The United States of America as represented by the Secretary of the Navy, Crane, IN (US)

(72) Inventors: James McKay, Springville, IN (US); Michael A. Sayward, Bloomington, IN (US); James Canary, Louisville, KY (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 638 days.

(21) Appl. No.: 14/869,119

(22) Filed: Sep. 29, 2015

(65) Prior Publication Data

US 2017/0073111 A1 Mar. 16, 2017

Related U.S. Application Data

(60) Provisional application No. 62/219,072, filed on Sep. 15, 2015.

(51) Int. Cl.

| | |
|---|---|
| ***B65D 90/00*** | (2006.01) |
| ***B65D 90/10*** | (2006.01) |
| ***B65D 90/18*** | (2006.01) |
| ***B65D 88/12*** | (2006.01) |

(52) U.S. Cl.

CPC ..... *B65D 90/00* (2013.01); *B65D 88/126* (2013.01); *B65D 90/006* (2013.01); *B65D 90/0033* (2013.01); *B65D 90/10* (2013.01); *B65D 90/18* (2013.01)

(58) Field of Classification Search

CPC .. B65D 90/00; B65D 90/0033; B65D 90/003; B65D 90/10; B65D 90/18; B65D 88/126; B65D 88/129; B65D 2519/00

See application file for complete search history.

(56) References Cited

U.S. PATENT DOCUMENTS

| | | | | |
|---|---|---|---|---|
| 3,514,005 A * | 5/1970 | Irwin | ..... | B65D 19/10 206/386 |
| 4,416,385 A * | 11/1983 | Clare | ..... | B65D 88/129 108/55.1 |
| 5,111,950 A * | 5/1992 | Wylenzek | ..... | B65D 88/129 108/55.1 |

* cited by examiner

*Primary Examiner* — Anthony D Stashick
*Assistant Examiner* — Blaine G Neway
(74) *Attorney, Agent, or Firm* — Naval Surface Warfare Center, Crane Division

(57) ABSTRACT

An equipment shipping, storage, and maintenance support system that includes a cover assembly including a variety of features and a mobile maintenance platform (MMP) coupled to the cover assembly via a plurality of latches. The MMP includes retractable wheel assemblies which enable lateral movement on a support surface in proximity to an end item with an equipment item mounted thereon (e.g., an aircraft with an aircraft radar). The MMP includes a vertical lift system that attaches or detaches from the equipment item to raise or lower the equipment item during maintenance activities. The cover can be installed on the MMP to provide protection against external environment in a storage or transit/shipping modes. The MMP also includes removable jacks which enable raising or lower of the MMP either during maintenance to reorient the equipment item for maintenance or storage purposes to include mitigate of undesirable environmental impacts from storage.

12 Claims, 8 Drawing Sheets

EQUIPMENT SHIPPING, STORAGE, AND MAINTENANCE SUPPORT SYSTEM

CROSS-REFERENCE TO RELATED APPLICATIONS

The present application claims priority to U.S. Provisional Patent Application Ser. No. 62/219,072, filed Sep. 15, 2015, entitled "EQUIPMENT SHIPPING, STORAGE, AND MAINTENANCE SUPPORT SYSTEM," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,283) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to equipment shipping, storage, and maintenance. In particular, embodiments of the invention provide a combination transport container, long-term storage, and maintenance stand/lift for electronics equipment such as a radar system.

Containers in current use do not provide effective protection of electronic equipment against environmental conditions, particularly in extended storage conditions at austere or remote locations. Moreover, remote or austere locations might not be properly equipped for the various logistics or maintenance tasks. For example, runways at austere locations might only have a single runway or limited to no facilities to perform maintenance functions. Large or heavy end items, particularly delicate end items susceptible to damage during handling and installation, e.g. large aircraft radar units that require elevation to a significant height, require a substantial amount of maintenance support equipment which is frequently not available in a variety of locations. Such support equipment often lacks necessary maneuverability for moving large or heavy items in small increments to facilitate installation on an end item. An example of needed maneuverability could be an aircraft that requires small adjustments to align, e.g., mounting bolts, connections to end item equipment with transmission shafts, electrical connections, hydraulic connections, exhaust stacks, etc. In addition, surfaces that are utilized for maintenance tasks or logistics tasks may be uneven, poorly built, unimproved, or poorly maintained, thus providing a difficult environment to perform necessary industrial or maintenance actions. These poor conditions are particularly difficult for manipulation, installation or removal of heavy or large end items such as engines, radar units, etc. Such environments or lack neglect of required maintenance support equipment can lead to substantial delays in performing required maintenance as well as creating a need to fly in or transport support equipment that might be required to perform required maintenance or logistics tasks. Moreover, failure analysis and testing has revealed that existing storage equipment, e.g., containers, canisters, etc, have a significant vulnerability to environmental conditions. In a case where such a container or canister is left on a ground surface, temperature variations between portions touching a ground surface and other sections can be significant. For example, a canister that is grounded can have differential temperature regions in its canister from one area to another such as, for example, a canister area having ground contact, that leads to undesirable internal environmental conditions in the canister, e.g., increased internal condensation as well as convection of air within the canister, etc. Undesirable environmental or storage conditions can then lead to increased or premature failure rates of equipment stored therein. Also, a need exists to provide a reusable system, which can be utilized multiple times with minimal to no refurbishing/cleaning from one use to another use. Yet another present problem is a lack of a storage unit capable of being used in intermodal travel, e.g., one that facilitates airborne, surface, and seaborne transportation using both civil and military transportation systems. Accordingly, a need exists for a single storage, installation/maintenance support equipment, and transportation solution that addresses a combination of these needs and problems.

According to an illustrative embodiment of the present disclosure, an Equipment Shipping, Storage, Lift and Installation (ESSLI) system is provided. One embodiment can include a reusable shipping, storage, and Mobile Maintenance Platform (MMP) that provides an atmospherically sealed environment during storage, as well as providing for receiving, transport, and on-site or point of install or replacement installation of equipment such as sensitive electronic cargo. In particular, embodiments of the invention can include an equipment shipping, storage, and maintenance support system that includes a cover assembly including a variety of features and the MMP coupled to the cover assembly via a plurality of latches. The MMP includes retractable wheel assemblies which enable lateral movement on a support surface in proximity to an end item with an equipment item mounted thereon (e.g., an aircraft with an aircraft radar). The MMP includes a vertical lift system that attaches or detaches from the equipment item to raise or lower the equipment item during maintenance activities. The cover can be installed on the MMP to provide protection against external environment in a storage or transit/shipping modes. The MMP also includes removable jacks which enable raising or lower of the MMP either during maintenance to reorient the equipment item for maintenance or storage purposes to include mitigate of undesirable environmental impacts from storage.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
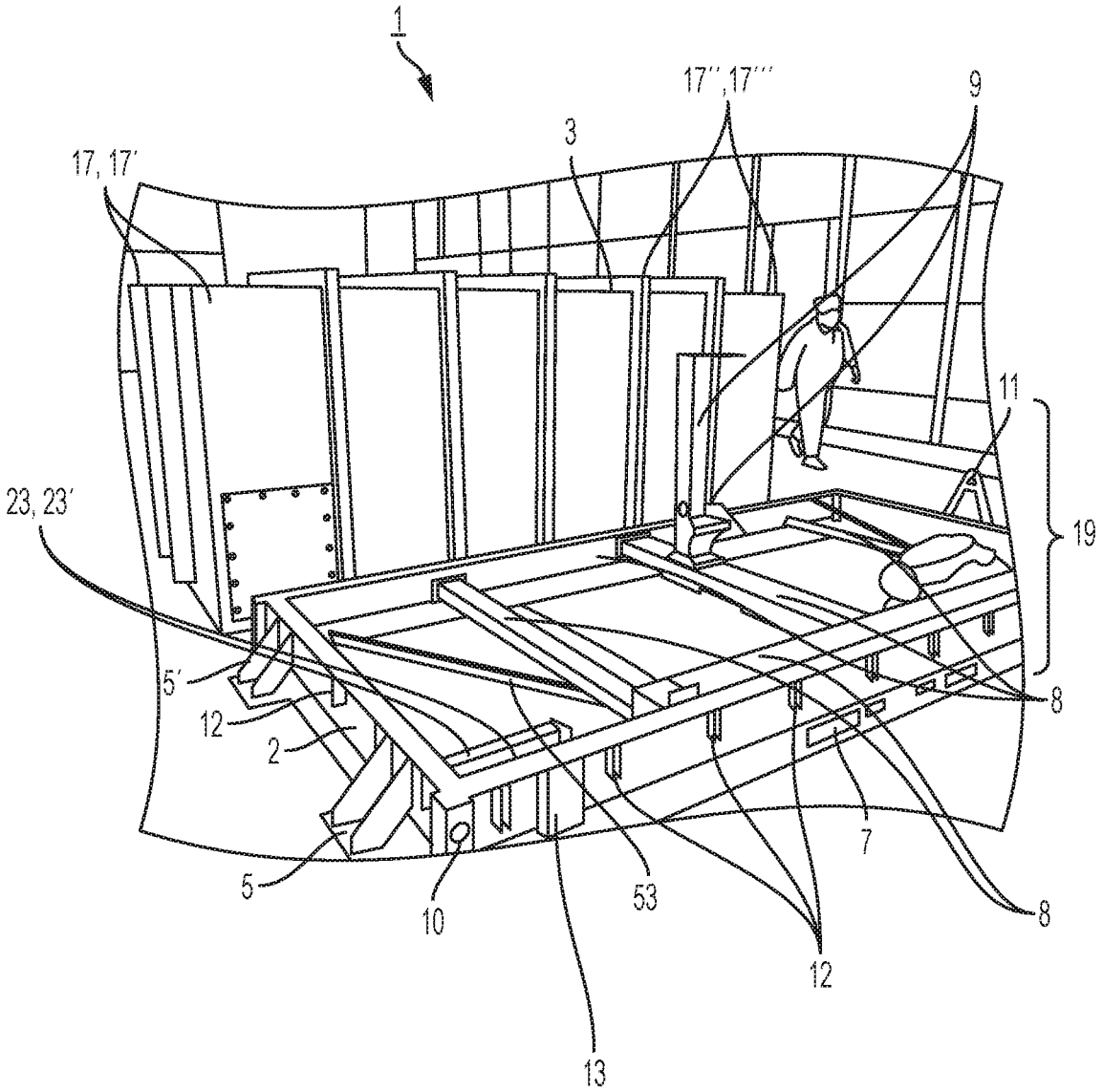
FIG. 1 shows a view of an antenna shipping, storage, lift, and installation system, e.g., an ESSLI system, with a cover removed in accordance with one exemplary embodiment of the invention.

The embodiments of the invention described herein are not intended to be exhaustive or to limit the invention to precise forms disclosed. Rather, the embodiments selected for description have been chosen to enable one skilled in the art to practice the invention.

FIGS. 1-7 show exemplary embodiments of the disclosure in accordance with various embodiments of the invention. One embodiment can include an ESSLI system 1. The cover assembly 3 can be lifted using cover lift sling couplers 17, 17', 17", 17''' disposed at lateral sides of upper corners of the cover assembly 3 at reinforced sections of the cover assembly 3 suitable for distributing weight of the ESSLI 1 system in sling lift operations. The exemplary ESSLI 1 major assemblies include a MMP 19 and a cover assembly 3 which mounts and seals to the MMP 19 to provide a protective enclosure for an equipment item, e.g., aircraft radar antenna, supported by the MMP 19 within the cover assembly 3. The MMP 19 includes a chassis 2 that is configured to receive, latch, (e.g. using thirty latches 12), and seal with the cover assembly 3. The MMP 19 also includes an equipment, e.g., antenna, lift station & frame support assembly (ALSFSA) 8 which is surrounded by and coupled to the chassis 2 using shock isolation mounts 21, 21', 21", 21''' (see FIG. 2) (e.g., a rubber or elastomer material formed to dampen or isolate shock and vibration from the chassis 2 to the ALSFSA 8) disposed around the ALSFA 8. The ALSFSA 8 includes an equipment mount and lift assembly, e.g., an antenna mount and lift assembly (AMLA) 9.

The MMP's 19 chassis assembly 2 includes a frame, chassis bottom wall piece 53, retractable caster assemblies 5, 5', 5", 5''', removable leveling jacks 23, 23', 23", 23''' (See FIG. 2) shown in a stowed position at two corners of the chassis assembly 2, a tow bar 11 with a retaining latch 11A (not shown but see FIG. 5), latches 12 (e.g. thirty latches surrounding the chassis assembly 2), and corner strap/chain tie down apertures 10, 10', 10", 10''' (see FIG. 2) at corners of the chassis assembly 2 frame. The frame and chassis bottom wall piece 53 are sealed together at their junction points with a seal or fastening (e.g., welding) to provide protection from external environmental conditions such as moisture or dirt entering into the ESSLI 1 internal cavity. Retractable caster assemblies 5, 5', 5", 5''' are attached to side sections of the chassis 2 in proximity to corner sections to enable movement on a supporting surface. The casters themselves in the retractable caster assemblies 5, 5', 5", 5''' have a locking mechanism (not shown) to prevent rotation of a wheel in the caster assembly 5, 5', 5", 5'''. Chassis assembly 2 has a set of lower forklift slots 7, 7' formed in a mid-section of the chassis' 2 frame forming an aperture or elongated cavity through the chassis 2 from one side to another which is designed to receive forklift forks or tynes (e.g., cantilevered arms attached to a forklift load carriage that engage a load, e.g, the ESSLI 1). To permit a forklift to raise the ESSLI and maneuver it without damage to the chassis 2. Chassis 2 is coupled with the ALSFSA 8 at interior sections of the chassis assembly 2. Exemplary ALSFSA 8 includes the AMLA 9 that provides lift capabilities for the MMP 19.

MMP 19 chassis assembly 2 is further formed with corner strap/chain tie-down apertures 10, 10', 10", 10''' at corners of the chassis assembly 2, leveling Jack 11, cover-to-chassis latches 12 (e.g. thirty), and removable jack attachment structures 13, 13', 13", 13''' positioned on external sides of the chassis assembly 2 frame near chassis assembly 2 corners. Once the ESSLI 1 has been positioned on a sufficiently hard or hard paved surface, retractable caster assemblies 5, 5', 5", 5''' can be lowered and used to move the system 1 without the assistance of material handling equipment or can be towed via a tow bar 11.

Figure 2:
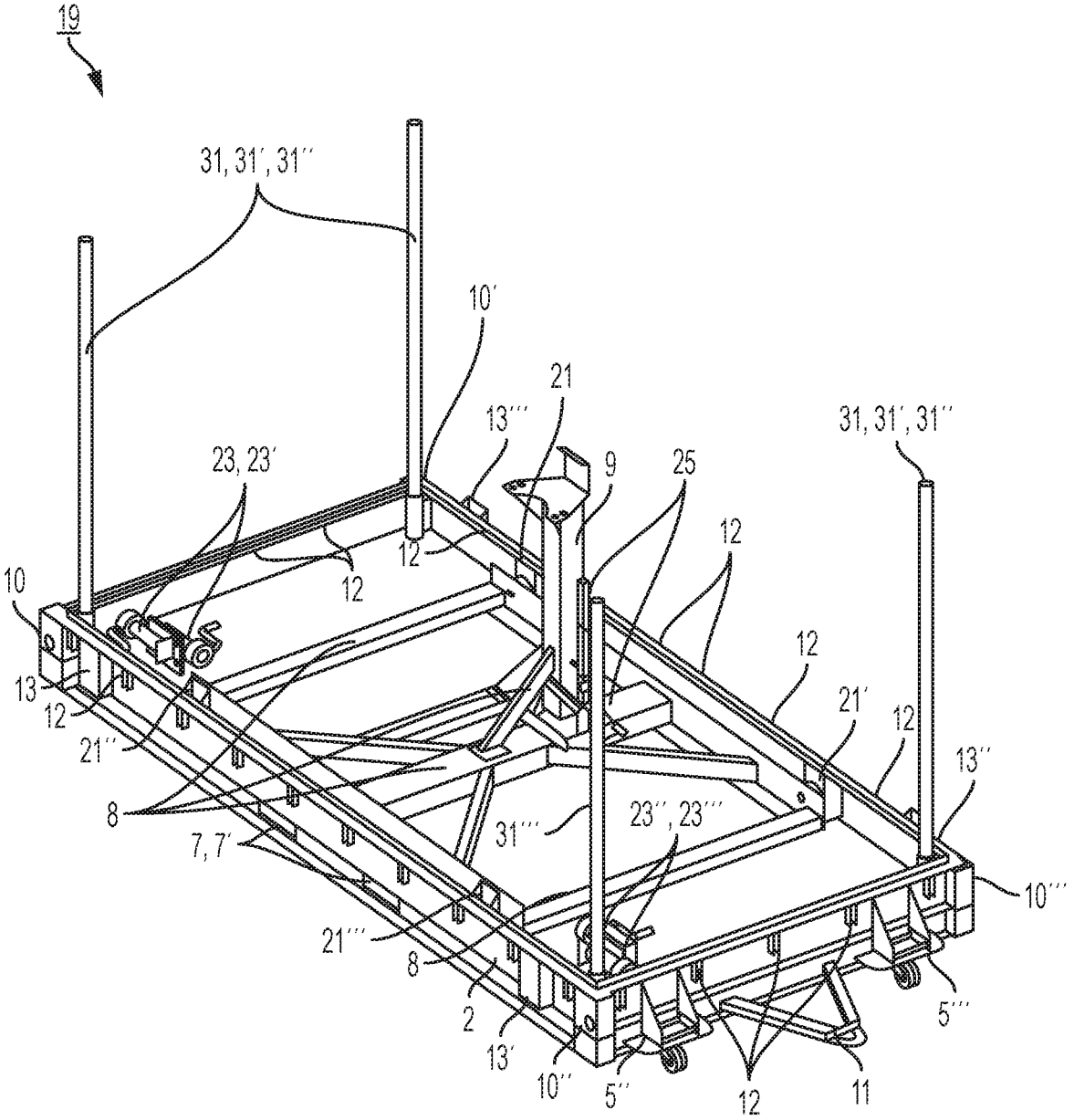
FIG. 2 is perspective view one example of a MMP in accordance with one embodiment of the invention.

FIG. 2 shows various elements shown in FIG. 1 with a focus on an exemplary embodiment of the MMP 19 which shows an additional or more detailed view of the FIG. 1 MMP 19 as well as showing some additional or different features from the FIG. 1 MMP 19. For example, FIG. 2 shows a better view of how shock and vibration isolation mounts 21, 21', 21", 21''' couple the ALSFA 8 and the chassis assembly 2 which isolate vibrations and shock between the chassis and the MMP 19. The shock and vibration isolation mounts 21, 21', 21", 21''' protect or mitigate shock or vibration damage to an equipment item mounted within the ESSLI 1, e.g., radar antenna, that is mounted on the AMLA 9 from impact or shock damage caused by vibration or shock to the chassis assembly 2 or cover assembly 3. FIG. 2 also shows cover assembly guide stations (CAGS) 31,31', 31", 31''' which insert into holes formed in upper corner areas of the chassis assembly 2 that provides mechanical guidance and alignment for installing the cover assembly 3 onto the chassis assembly 2.

The removable leveling jacks 23, 23', 23",23''' include a jack section and a jack pad which spreads out force on a support surface and are shown in a stowed position The removable leveling jacks 23, 23', 23",23''' are designed to be removed from their stowed position and installed on leveling jack attachment structures 13,13',13"13''' to provide an ability to level the MMP 19 as well as to permit three-axis movement of the equipment item positioned on the AMLA 9 to facilitate installation or removal of such an equipment item, e.g., radar antenna, from an end item such as an aircraft nose or radar attachment bulkhead. The lift jack, gear assembly, and handle 25 provides a capability for raising or lowering the equipment item mounted on the AMLA 9 and its antenna mount bracket 27 (see FIG. 3).

Figure 3:
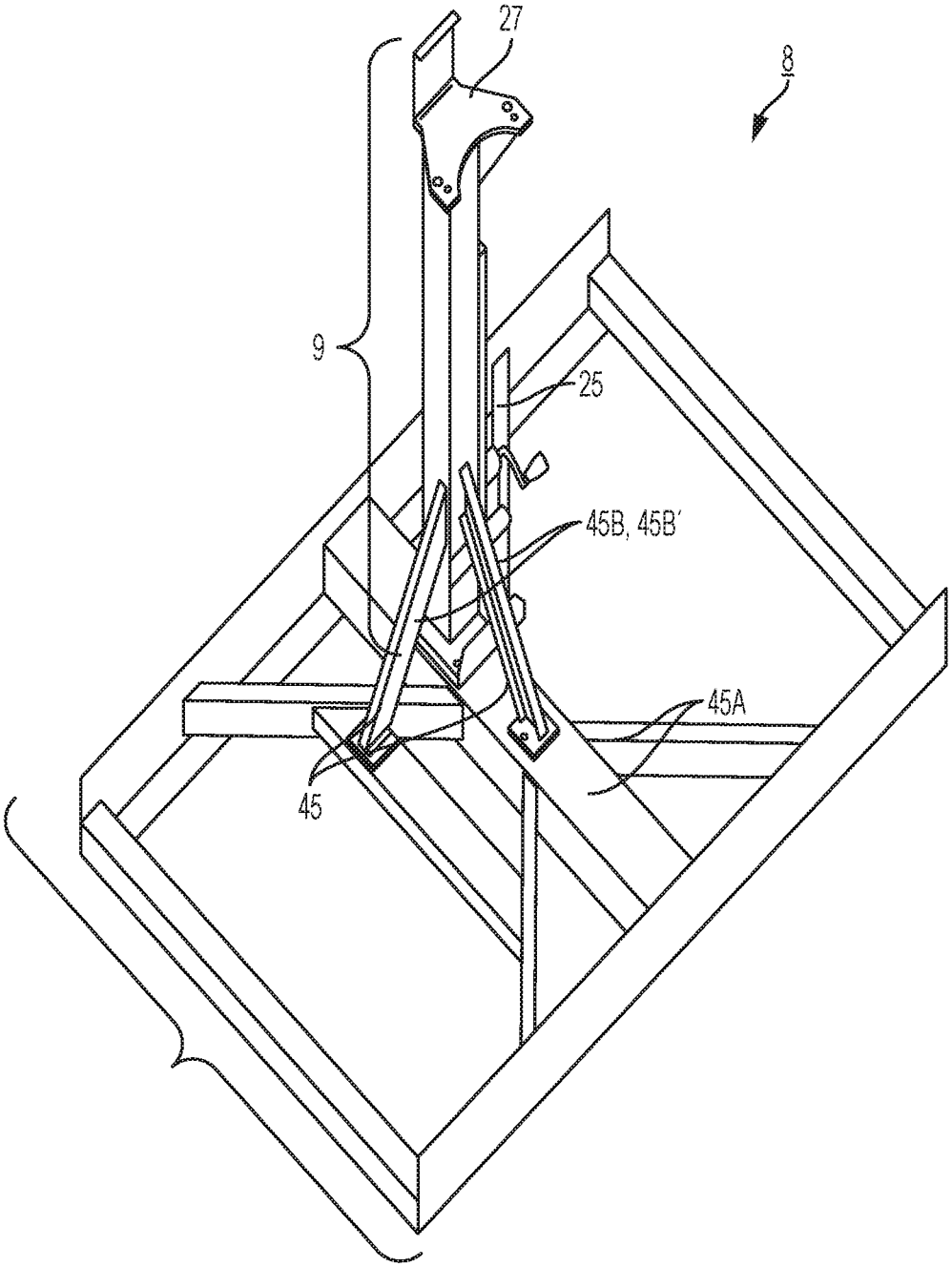
FIG. 3 shows an antenna lift station and frame support assembly which is a subassembly to the FIG. 3 MMP in accordance with one exemplary embodiment of the invention.

FIG. 3 shows a drawing of an exemplary ALSFA 8 which attaches to the chassis assembly 2 of the overall MMP assembly 19. An antenna could be mounted on the antenna mount bracket 27 that is then further supported by frame support assembly (FSA) 45. Note the FSA 45 has a variety of support structures to include interconnecting lateral bracing structures 45A as well as diagonal vertical bracing structures 45B, 45B'.

Figure 4:
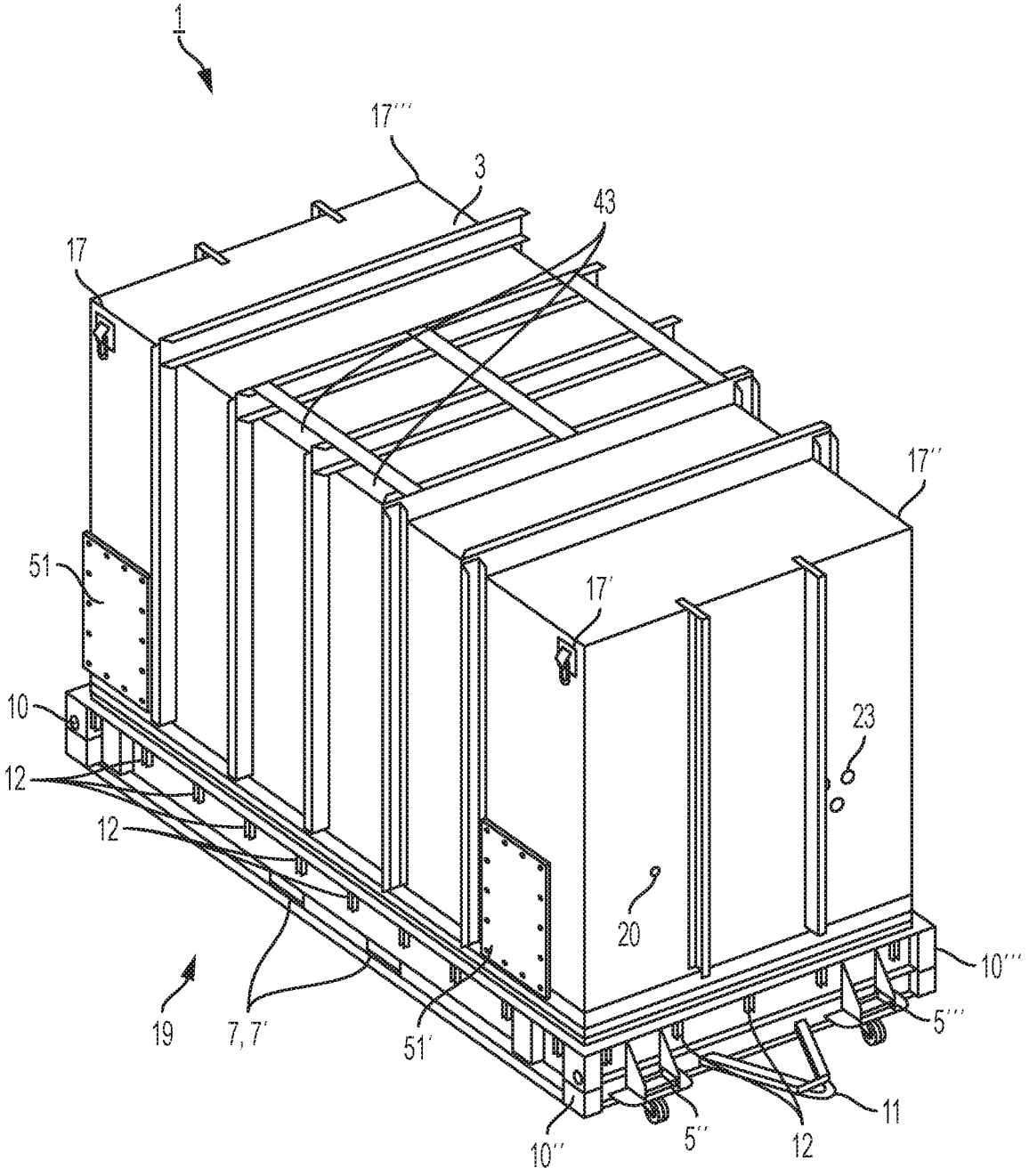
FIG. 4 shows an example of one exemplary antenna shipping, storage, lift, and installation system, e.g., ESSLI system, with cover installed in accordance with one exemplary embodiment of the invention.

FIG. 4 shows a perspective drawing of the exemplary ESSLI 1 such as, e.g., shown in FIGS. 1-3, fully assembled with the cover assembly 3 installed on the FIG. 2, 3 MMP 19. Cover assembly 3 is formed with cover assembly forklift slot frames 43 which are formed to accept the forklift forks or tynes and lift or move the cover assembly 3 off of the MMP 19 via material handling equipment, e.g., a forklift. Access to an interior of the cover assembly 3 can be done via one or more maintenance access cover assemblies or panel assemblies, e.g., 51, 51', or by lifting and removing the cover assembly 3. Removal of maintenance access panels or covers to these maintenance access cover or panel assemblies 51, 51' allow for easy access to some key components of the ESSLI 1 that help maintain preconfigured, desired conditions such a inspection or replacement of desiccant bags installed within the ESSLI 1 to dry an internal environment of the ESSLI 1. The cover assembly 3 can be formed to include a maintenance access aperture (not shown) formed into a wall of the cover assembly 3 that has the maintenance access cover or panel bolted onto the maintenance access aperture (forming the cover or panel assemblies 51, 51') to provide for maintenance personnel access into the ESSLI 1. The maintenance access panels are placed and coupled to the cover assembly 3 over the maintenance access aperture and secured to the cover assembly 3 via fasteners such as bolts. A seal or sealant (not shown) can be included in the cover or panel assemblies 51, 51' disposed between the maintenance access covers or panels along the perimeter of each of the maintenance access apertures. The seal or sealant can be configured to provide a barrier between an internal section of MMP 19 and an external environment (e.g., moisture or dirt). Additional features of the FIG. 4 embodiment include pressure relief valves 23 (three in this case) and a humidity indicator 20 which indicates via a color indication of humidity conditions of the internal environment of the ELSSI 1. Pressure relief valves 23 can be used in intermodal transportation activities such as, e.g., required for shipping of the ESSLI 1 using aircraft (not shown).

Figure 5:
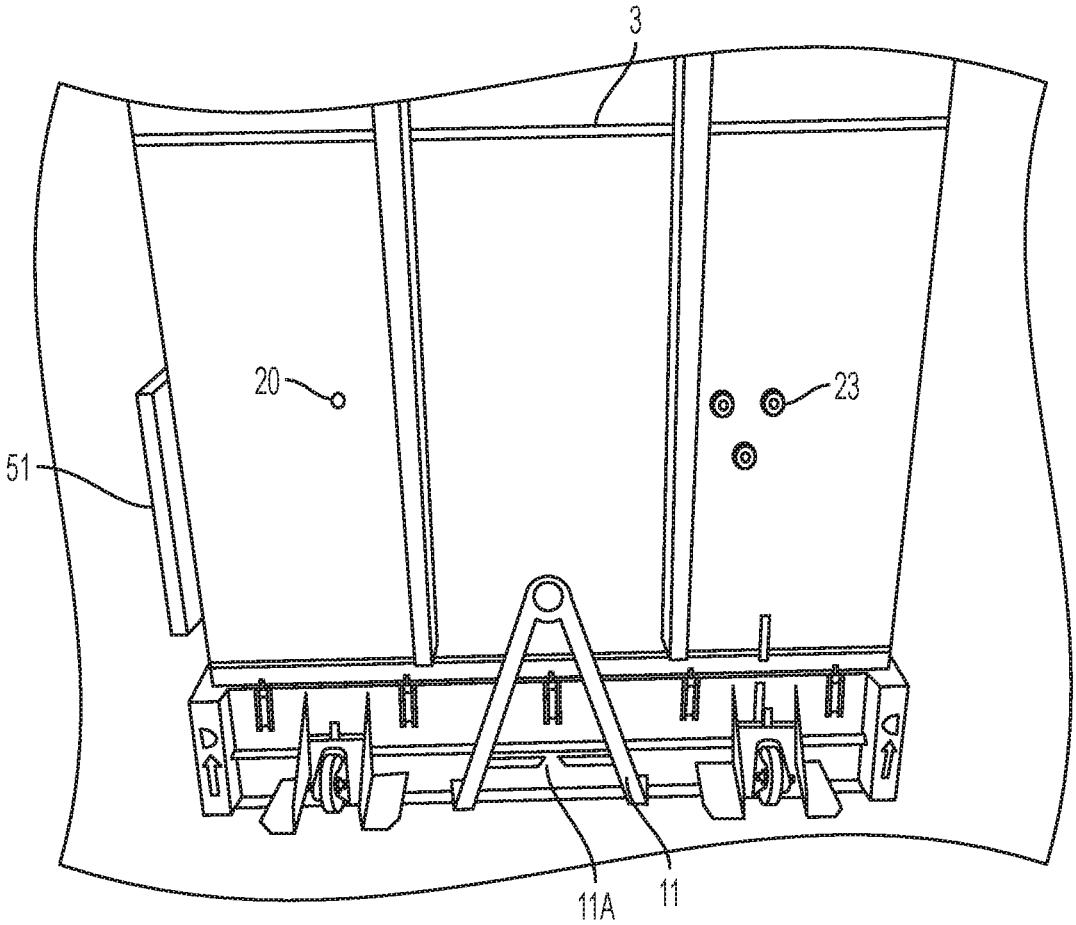
FIG. 5 shows one end of the FIG. 4 cover assembly in accordance with one exemplary embodiment of the invention.

FIG. 5 shows an end view of the FIGS. 1-5 ESSLI 1 showing the cover assembly 3 over the exemplary MMP 19 base. Another view is shown of one of the maintenance cover panels 51, the humidity indicator, 20, and the pressure relief valves 23 as well as the tow bar 11 with the retaining latch 11A. The humidity detector 20 can be inspected to show, e.g., a blue color, indicating a particular environmental condition within the ESSLI 1. If the humidity detector 20 indicates another color, e.g., pink, such an indication can show, e.g., desiccant drying bags require replacement within the system 1

Figure 6:
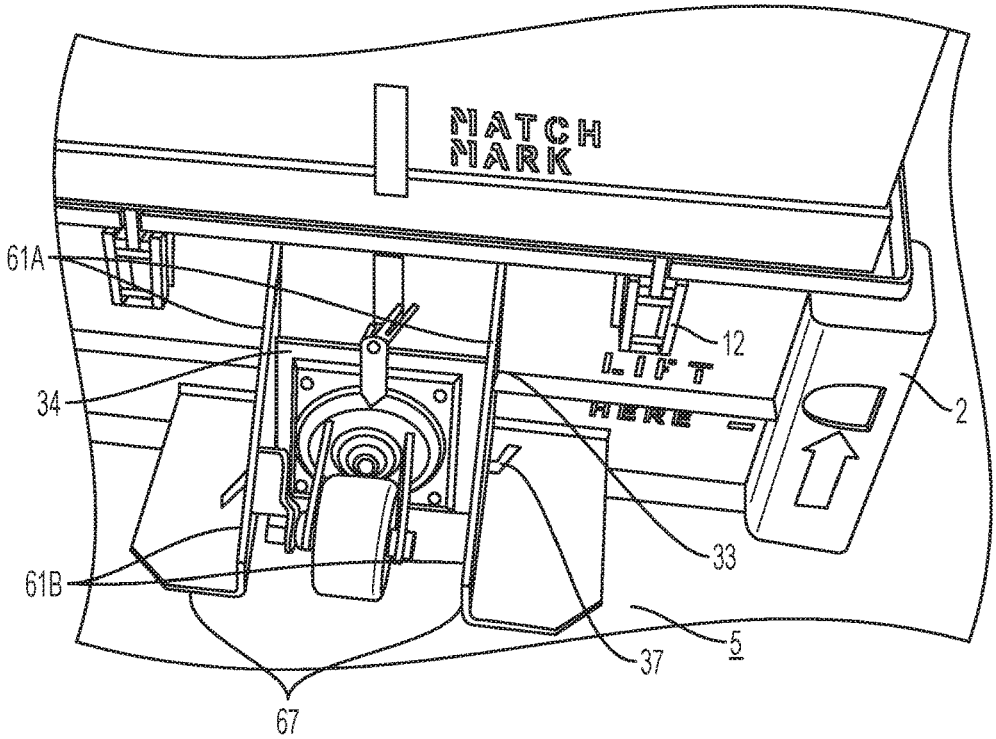
FIG. 6 shows a detail view of a retractable wheel or caster assembly mounted on ends of the MMP in accordance with one exemplary embodiment of the invention.

FIG. 6 shows a closer view of one of the exemplary retractable caster assemblies, e.g., 5, that can be lowered or raised by removal of a locking clip 33 and pulling a caster assembly position locking pin 34 (a separate pin for each assembly) out of retracted position pin holes 61A in lateral retractable caster assembly frame 67 mounted to the chassis 2 and pivoting the caster assembly 5 to align with another hole set (extended pin holes 61B) in the lateral retractable caster assembly frame 67 extending from the chassis assembly 2 so the caster assembly 5 is lowered so it extends below the chassis assembly 2. The lowered caster assembly 5 thus permits movement on the hard or paved surface in a maneuver position. A pivot pin and locking clip assembly 37 permits the caster assembly 5, e.g., to pivot and acts as a hinge type structure as well as being able to support the caster assembly 5 in the extended position (e.g. carrying distributed weight of the ESSLI 1 and enabling movement.

Figure 7:
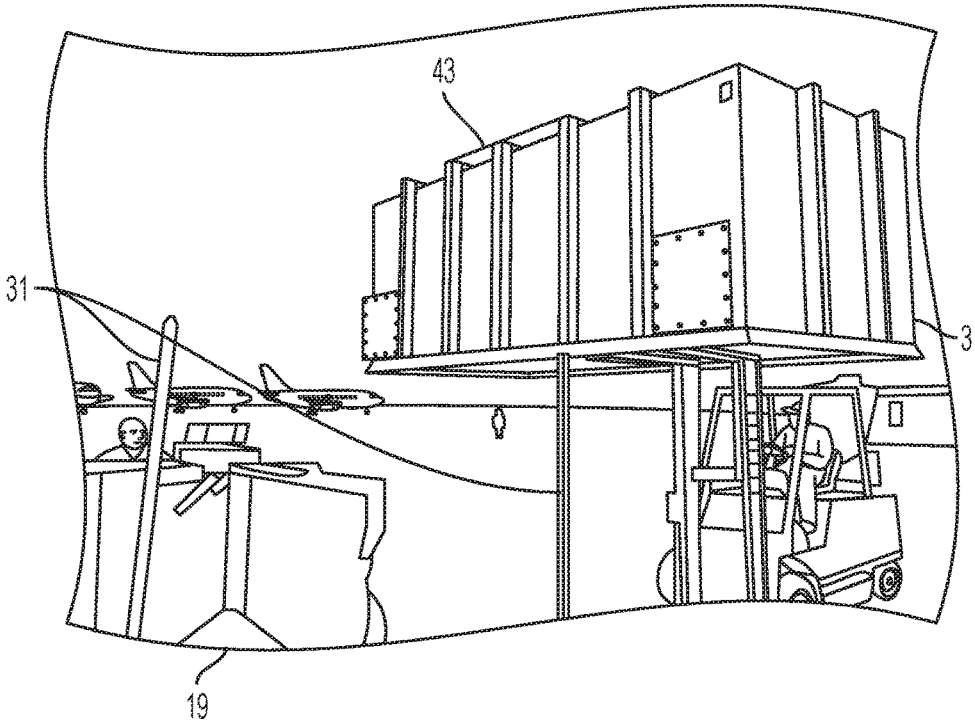
FIG. 7 shows a cover assembly being removed by material handling equipment, e.g., a forklift in accordance with one exemplary embodiment of the invention.

FIG. 7 shows a view of the cover assembly 3 being lifted into position for lowering on the MMP 19 by a forklift with its forks or tynes engaged and inserted into the cover assembly forklift slot frames 43.

Figure 8:
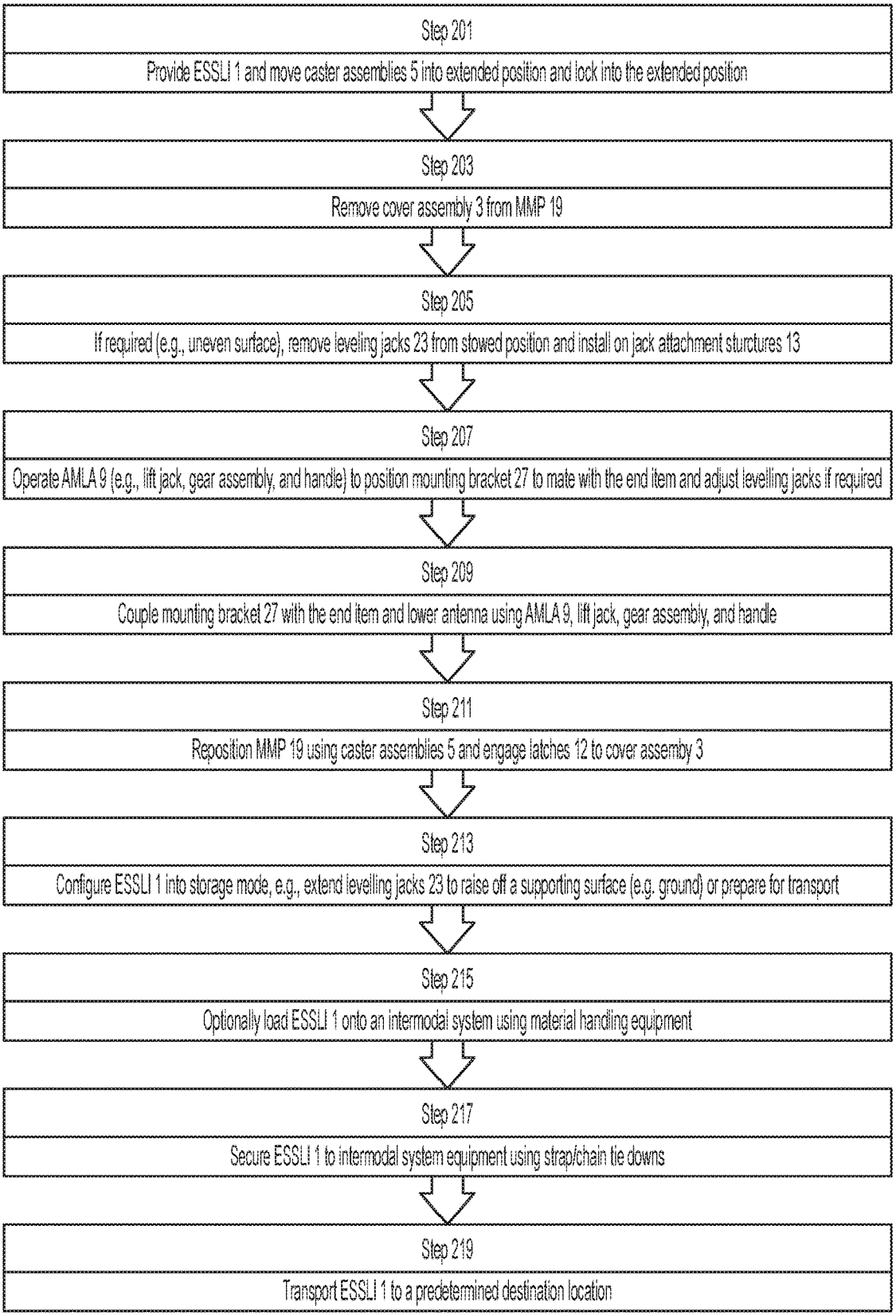
FIG. 8 shows an exemplary method of using an embodiment of the ESSLI 1 system in accordance with one embodiment of the invention.

FIG. 8 outlines a method of using the ESSLI 1, which can include: step 201: providing the ESSLI 1 and lowering the caster assemblies 5, 5', 5", 5'" into the extended position and locking them into position using the caster assembly locking pins 34 inserted into the extended pin holes 61B for each assembly 5. Step 203: removing the cover assembly 3 from the MMP 19 using material handling equipment, such as a forklift inserting forklift forks or tynes into the Cover Assembly Forklift Slot Frame 43 or using a crane coupled to the ESSLI 1 via the cover lift sling couplers 17, 17', 17", 17'", and positioning the MMP 19 under an end item, e.g., an aircraft fuselage nose section, using the caster assemblies 5, 5', 5", 5'" in the extended configuration. Step 205: If required due to support surface condition (e.g. not level), a next step can include removing the removable leveling jacks 23, 23', 23", 23'" from their stowed position attached to the chassis 2 and installing them on the leveling jack attachment structures 13,13',13"13'" to provide an ability to adjustably level the MMP 19 as well as to permit three-axis movement of the equipment item positioned on the AMLA 9 to facilitate installation or removal of such an equipment item, e.g., radar antenna, from the end item such as the aircraft nose or radar attachment bulkhead. Step 207: operating the lift jack, gear assembly, and handle 25 to raise or lower the antenna mounted on the AMLA 9 and its antenna mount bracket 27 to position the antenna mount bracket 27 in contact with the antenna then, if required, adjusting the leveling jacks 23, 23', 23",23'" and/or the AMLA 9 height to mate the antenna mount bracket 27 with a connection point on the antenna then installing antenna mount bracket 27 hardware to couple the antenna mount bracket 27 with the antenna. At step 209, removing antenna-to-end-item mounting hardware and other connections (e.g. electrical wiring, cooling connections, etc) and lowering the antenna using the AMLA 9 and the lift jack, gear assembly, and handle 25 to a lowered or stowed position on the MMP 19. At step 211, repositioning the MMP 19 laterally using the caster assemblies 5, 5', 5", 5'", repositioning and lowering the cover assembly onto the MMP 19, and latching the latches 12 to the cover assembly 3. At step 213, the ESSLI 1 can be positioned into a storage mode to include ensuring, e.g., desiccant bags, are positioned in the ESSLI 1 and the ESSLI is configured, if required, for mitigating undesirable internal environmental conditions through, e.g., leveling via the leveling jacks 23, 23', 23",23'" on a support surface. At step 215, a loading process can include loading the ESSLI 1 onto a truck, aircraft, or rail intermodal system using material handling equipment, e.g., a forklift engaging its tynes or forks into forklift slots 7, 7' or a crane and sling coupled to cover lift sling couplers 17, 17', 17", 17'". At step 217, securing the ESSLI 1 to the intermodal system equipment, e.g., truck, rail car, or aircraft load bed, using at least strap/chain tie downs coupling the corner strap/chain tie-down apertures 10, 10', 10", 10'" with the intermodal system equipment. At step 219, transporting the ESSLI 1 to a predetermined destination location. If required, step 213 can be repeated at the predetermined destination location.

Figure 9:
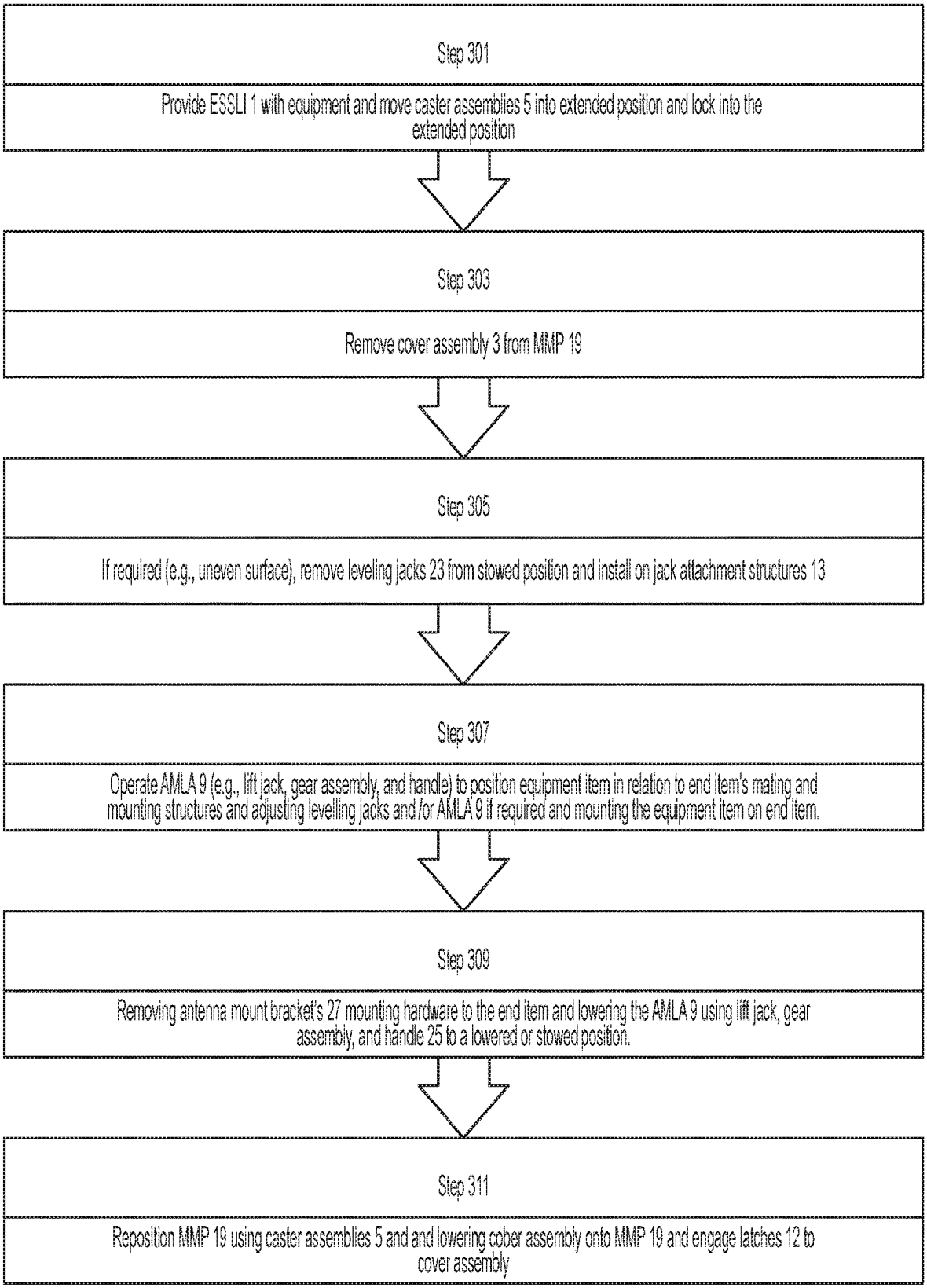
FIG. 9 shows and exemplary method of installation of an equipment item stored in the ESSLI 1 in accordance with one embodiment of the invention.

For installation of an equipment item stored in the ESSLI 1, an installation process can include that which is outlined in FIG. 9: step 301: providing the ESSLI 1 with the equipment item contained therein mounted on the antenna mount 27 and lowering the caster assemblies 5, 5', 5", 5'" into the extended position and locking them into position using the caster assembly locking pins 34 inserted into the extended pin holes 61B for each assembly 5. Step 303: removing the cover assembly 3 from the MMP 19 using material handling equipment, such as a forklift inserting forklift forks or tynes into the Cover Assembly Forklift Slot Frame 43 or using a crane coupled to the ESSLI 1 via the cover lift sling couplers 17, 17', 17", 17'", and positioning the MMP 19 under an end item, e.g., an aircraft fuselage nose section, using the caster assemblies 5, 5', 5", 5'" in the extended configuration. Step 305: If required due to support surface condition (e.g. not level), a next step can include removing the removable leveling jacks 23, 23', 23", 23'" from their stowed position attached to the chassis 2 and installing them on the leveling jack attachment structures 13,13',13"13'" to provide an ability to adjustably level the MMP 19 as well as to permit three-axis movement of the equipment item positioned on the AMLA 9 to facilitate installation of such an equipment item, e.g., radar antenna, from the end item such as the aircraft nose or radar attachment bulkhead. Step 307: operating the lift jack, gear assembly, and handle 25 to raise or lower the antenna mounted on the AMLA 9 and its antenna mount bracket 27 to position the equipment item in relation to the end item's equipment item mating and mounting structures (e.g., the antenna's mounting structures on the aircraft) then, if required, adjusting the leveling jacks 23, 23', 23", 23'" and/or the AMLA 9 height to further align end item mounting hardware with the end item's mating and mounting structures then mounting the end item on the end item's mating and mounting structure with end item mounting equipment. At step 309, removing antenna mount bracket's 27 mounting hardware to the end item, e.g. antenna, and lowering the AMLA 9 using the lift jack, gear assembly, and handle 25 to a lowered or stowed position on the MMP 19. At step 311, repositioning the MMP 19 laterally using the caster assemblies 5, 5', 5", 5'", repositioning and lowering the cover assembly onto the MMP 19, and latching the latches 12 to the cover assembly 3.

One exemplary embodiment of the invention is configured with structure and materials configured to enable the antenna lift station and frame support assembly 8 with a load limit of four hundred pound antenna. Alternatively, cover lift sling couplers 17, 17', 17", 17'" can be used to raise or lower the cover assembly 3. The cover assembly guide stanchions 31, 31', 31", 31" guide the cover assembly 3 onto the MMP 19 to ensure the cover assembly 3 is properly aligned to the chassis 2 and further aids in ensuring the cover assembly 3 is sealed against environmental conditions after latches 12 are latched to the chassis assembly 2.

Embodiments of the ESSLI 1 can be stored in different configurations depending on environmental conditions. The caster assemblies 5, 5', 5", 5'" can be stored in the extended and maneuverable position or retracted for intermodal transportation or sitting directly on a support surface. Alternatively if environmental conditions (e.g., wet, cold, uneven surface, wide temperature variations that require even cooling/heating throughout the ESSLI 1) require, the ESSLI 1 can be stored so that the leveling jacks 23, 23', 23",23'" can used, e.g., to keep the ESSLI 1 elevated so that environmental conditions inside the interior of the system 1 can be more equalized with ambient temperature.

Although the invention has been described in detail with reference to certain preferred embodiments, variations and modifications exist within the spirit and scope of the invention as described and defined in the following claims.

The invention claimed is:

1. A method of utilization for an equipment shipping, storage and maintenance support system (ESSMSS) comprising:

providing said ESSMSS comprising:

a cover assembly comprising at least one pressure equalization valve, at least one removable access panel or hatch configured to enable access into the cover assembly, a humidity detection detector configured to indicate a humidity state of an internal environment within said cover assembly, a plurality of latch engaging sections disposed around a perimeter of said cover, and a first and second material handling interface sections respectively configured to engage with a first and second material handling equipment to lift or move said cover assembly, wherein said first material handling interface section comprises an aperture which is formed through first portion of said cover assembly, wherein said second material handling interface sections comprises a plurality of load bearing structures coupled in proximity to corner sections of said cover configured to engage with a plurality of lifting cables; and a mobile maintenance platform (MMP) comprising a chassis, a plurality of vibration and shock mounts coupled or disposed on opposing internal sides of said chassis, a frame disposed within said chassis and coupled to said plurality of vibration and shock mounts, and a vertical lift assembly coupled to said frame configured to brace said vertical lift assembly to support said vertical lift assembly in a fixed position, wherein said chassis further comprises a plurality of retractable wheel assemblies disposed at opposing sides of said chassis configured to lock in an extended or retracted position using a locking structure disposed in a first and second position with respect to said retractable wheel assemblies, and thus selectively provide lateral movement capacity for said chassis over a support surface, a towbar configured to couple with a towing apparatus pivotably coupled to said chassis on one end, a plurality of removable leveling jack assemblies configured to removably attach to said chassis in a stowed position internal to said chassis and an installed position external to said chassis configured to selectively raise or lower said chassis in the installed position so as to raise or lower said chassis in three axis, and a plurality of latches configured to couple said chassis to said cover assembly by engaging with said latch engaging sections, wherein said chassis and cover assembly further comprise at least one pressurization sealing section configured to provide a pressure seal between said chassis a section and said cover assembly, wherein said vertical lift assembly comprises a jacking assembly or raising or lowering assembly configured to extend a section of the vertical lift assembly, said vertical lift assembly further comprises an equipment mounting section configured to mount to an equipment item coupled to an end item;

mounting said retractable wheel assemblies onto said installed position and lowering said retractable wheels into said extended position and locking them into a position using at least one locking pin for each said retractable wheel assembly;

removing said cover assembly from said MMP using said first or second material handling equipment;

positioning the MMP under said equipment item coupled to an end item using said retractable wheel assemblies to laterally move said MMP on said support surface;

operating said vertical lift assembly to raise or lower the vertical lift assembly to position said vertical lift assembly with respect to the equipment item that is coupled to an end item to facilitate coupling said vertical lift assembly with said equipment item;

installing end item mounting hardware to the equipment item and said vertical lift assembly to couple the vertical lift assembly to the equipment item;

decoupling the equipment item from the end item and lowering the vertical lift assembly to a lowered or stowed position on the MMP;

repositioning the MMP away from the end item laterally using the retractable wheel assemblies; and repositioning and lowering the cover assembly onto the MMP and latching said latches to the cover assembly.

2. A method as in claim 1, further comprising removing said plurality of removable leveling jack assemblies from said stowed position and attaching said plurality of removable leveling jack assemblies to said chassis in said installed positions to provide an ability to adjustably raise and level the ESSMSS above a storage area support surface.

3. A method as in claim 1, further comprising loading the ESSMSS onto a mobile transport system using said first or second material handling equipment to couple with said first or second material handling interfaces and moving the ESSMSS onto said mobile transport system;

securing the ESSMSS to said mobile transport system using a plurality of coupling structures; and transporting the ESSMSS to a predetermined destination.

4. A method of installation for an equipment item stored in an equipment shipping, storage, and maintenance support system (ESSMSS) comprising:

providing the ESSMSS with an equipment item contained therein, wherein said ESSMSS comprises:

a cover assembly comprising at least one pressure equalization valve, at least one removable access panel or hatch configured to enable access into the cover assembly, a humidity detection detector configured to indicate a humidity state of an internal environment within said cover assembly, a plurality of latch engaging sections disposed around a perimeter of said cover, and a first and second material handling interface sections respectively configured to engage with a first and second material handling equipment to lift or move said cover assembly, wherein said first material handling interface section comprises an aperture which is formed through first portion of said cover assembly, wherein said second material handling interface sections comprises a plurality of load bearing structures coupled in proximity to corner sections of said cover configured to engage with a plurality of lifting cables; and a mobile maintenance platform (MMP) comprising a chassis, a plurality of vibration and shock mounts coupled or disposed on opposing internal sides of said chassis, a frame disposed within said chassis and coupled to said plurality of vibration and shock mounts, and a vertical lift assembly coupled to said frame configured to brace said vertical lift assembly to support said vertical lift assembly in a fixed position, wherein said chassis further comprises a plurality of retractable wheel assemblies disposed at opposing sides of said chassis configured to lock in an extended or retracted position using a locking structure disposed in a first and second position with respect to said retractable wheel assemblies, and thus selectively provide lateral movement capacity for said chassis over a support surface, a towbar configured to couple with a towing apparatus pivotably coupled to said chassis on one end, a plurality of leveling jack assemblies configured to removably attach to said chassis in a stowed position internal to said chassis and an installed position external to said chassis configured to selectively raise or lower said chassis in the installed position so as to raise or lower said chassis in three axis, and a plurality of latches configured to couple said chassis to said cover assembly by engaging with said latch engaging sections, wherein said chassis and cover assembly further comprise at least one pressurization sealing section configured to provide a pressure seal between said chassis a section and said cover assembly, wherein said vertical lift assembly comprises a jacking assembly or raising or lowering assembly configured to extend a section of the vertical lift assembly, said vertical lift assembly further comprises an equipment mounting section configured to mount to said equipment item coupled to an end item;

lowering the retractable wheel assemblies into the extended position and locking them into position using locking pins inserted into a frame section and a wheel section for each retractable wheel assembly;

removing said cover assembly from the MMP using the first or second material handling equipment to couple with the first or second material handling equipment interface sections and move said cover assembly away from the MMP;

positioning the MMP under the equipment item using said plurality of retractable wheel assemblies;

operating the vertical lift assembly comprising the jacking assembly or raising or lowering assembly, to raise or lower said equipment item to position said equipment item with respect to an equipment item mounting structure on said end item;

removing mounting hardware coupling said equipment item with said vertical lift assembly and installing said equipment item on said end item;

lowering the vertical lift assembly into said stowed position;

repositioning the MMP laterally using the retractable wheel assemblies; and repositioning and lowering the cover assembly onto the MMP, and latching said latches to the latch engaging sections on cover assembly.

5. A method as in claim 1, wherein said wherein said vertical lift assembly further comprises a lift jack gear assembly and a vertical lift assembly operator control.

6. A method as in claim 5, wherein said vertical lift assembly operator control comprises a hand crank coupled with the gear assembly to operate the vertical lift assembly.

7. A method as in claim 3, wherein said mobile transport system comprises a truck, rail car, or aircraft load bed.

8. A method as in claim 3, wherein said first material handling equipment comprises a forklift and the second material handling equipment comprises a crane.

9. A method as in claim 3, wherein said plurality of coupling structures comprises a chain, strap, or tie-down.

10. A method as in claim 4, wherein said jacking assembly or raising or lowering assembly further comprises a lift jack, gear assembly, and handle.

11. A method as in claim 9, wherein said chain, strap, or tie-down couples the mobile transport system with the chassis, wherein one section of the chain, strap, or tie-down couples with the ESSMSS through a plurality of strap, chain, or tie down aperture sections that are formed through respective spaced apart sections of the chassis.

12. A method as in claim 4, wherein said first material handling equipment comprises a forklift and the second material handling equipment comprises a crane.

* * * * *